US006299011B1

(12) United States Patent
Rosenfeldt

(10) Patent No.: US 6,299,011 B1
(45) **Date of Patent: *Oct. 9, 2001**

(54) STACKABLE KNOCK-DOWN BOX

(75) Inventor: Niels Rosenfeldt, White River (ZA)

(73) Assignee: Clip-Lok International Ltd., Tortola (VG)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/224,023

(22) Filed: Dec. 31, 1998

(30) Foreign Application Priority Data

Jan. 12, 1998 (ZA) ..... 98/0207
Oct. 6, 1998 (ZA) ..... 98/9096

(51) Int. Cl.[7] ..... B65D 6/16

(52) U.S. Cl. ..... 220/4.29; 16/388; 206/509; 206/600; 217/16; 217/48; 217/65

(58) Field of Search ..... 217/43 A, 48, 217/16, 12 R, 43 R, 65, 69, 13, 45, 67; 206/509, 511, 512, 599, 600; 220/4.28, 4.29, 4.31, 4.33, 4.34; 16/387, 388, 389, 390–392, 252

(56) References Cited

U.S. PATENT DOCUMENTS

| | | | | |
|---|---|---|---|---|
| 529,230 | * | 11/1894 | Zimmerman | 220/531 X |
| 598,431 | * | 2/1898 | McBride | 217/47 X |
| 887,532 | * | 5/1908 | Sherman | 217/67 |
| 1,311,651 | * | 7/1919 | Kanster | 16/390 |
| 1,640,525 | * | 8/1927 | Belliveau | 16/390 |
| 2,381,874 | * | 8/1945 | Britton | 217/12 R |
| 2,566,500 | * | 9/1951 | Rose et al. | 217/13 |
| 2,854,165 | * | 9/1958 | Foster et al. | 217/12 A |
| 3,153,807 | * | 10/1964 | Nyman | 16/390 |
| 3,262,597 | * | 7/1966 | Coffey, Jr. | 217/12 R |
| 3,323,674 | * | 6/1967 | Nist, Jr. | 217/69 X |
| 3,836,044 | * | 9/1974 | Tilp et al. | 220/554 X |
| 3,875,871 | * | 4/1975 | Thornton et al. | 220/531 X |
| 4,167,232 | | 9/1979 | Munk et al. . | |
| 4,347,941 | * | 9/1982 | Johansson et al. | 220/4.29 X |
| 4,453,471 | * | 6/1984 | Harrington et al. | 217/69 X |
| 4,796,392 | * | 1/1989 | Graham, Jr. | 217/65 X |
| 4,867,327 | * | 9/1989 | Roland | 2220/4.28 X |
| 5,323,921 | * | 6/1994 | Olsson | 217/12 R |
| 5,617,967 | * | 4/1997 | Neidhart | 206/600 X |
| 6,003,203 | * | 12/1999 | Fowlston | 16/225 |

FOREIGN PATENT DOCUMENTS

| | | | | |
|---|---|---|---|---|
| 719974 | * | 10/1965 | (CA) | 217/13 |
| 237110 | * | 7/1945 | (CH) | 217/43 |
| 4314150 | * | 9/1994 | (DE) | 206/386 |
| 504515 | * | 7/1920 | (FR) | 217/16 |
| 1272174 | * | 8/1961 | (FR) | 206/509 |
| 06692 | * | 3/1994 | (WO) | 220/4.28 |

* cited by examiner

*Primary Examiner*—Allan N. Shoap
*Assistant Examiner*—Joseph C. Merek
(74) *Attorney, Agent, or Firm*—Kenyon & Kenyon

(57) ABSTRACT

A stackable knock down box is provided for the bulk transportation and storage of fresh produce such as fruit. The box comprises a base pallet, and six side wall panels which are hinged together to define a composite side wall enclosure which can be folded into a stack. A number of drop-away base clip arrangements are provided for releasably holding the composite side wall enclosure to the base pallet in both its erected and folded conditions. The box can be stacked in both the erected and folded conditions, and includes a number of panel aligning inserts located at the upper edge corners of the side walls. Each panel aligning insert is formed with an angled contact face which slopes downwardly and outwardly. A number of complemental panel aligning formations are formed within pedestals on the pallet, and have an angled contact face which slopes upwardly and inwardly. As a result, inter-engagement of the contact faces results in the upper edges of the side walls being urged inwardly into inter-engagement with the complemental panel aligning formations.

10 Claims, 9 Drawing Sheets

STACKABLE KNOCK-DOWN BOX

BACKGROUND OF THE INVENTION

THIS invention relates to a stackable knock down box which is primarily but not exclusively intended for the bulk transportation and storage of fresh produce such as fruit.

Packaging for fruit and other fresh produce is expensive, particularly in the case of sacrificial packaging which has to be disposed of after a single use. In many countries which import fruit, it is obligatory for the supplier in one way or another to dispose of the fruit packaging.

It is accordingly desirable to provide a knock down bulk fruit box which is reusable, and which can be stacked both when folded and erected. One requirement of such a re-usable box is that it needs to be sufficiently rugged to withstand repeated use and abuse in the erected and folded conditions, particularly when stacked.

SUMMARY OF THE INVENTION

According to a first aspect of the invention there is provided a stackable knock down box comprising a base including a base panel supported on a plurality of pedestals, a plurality of side wall panels, hinge means connecting the side wall panels together to define a composite side wall enclosure, the hinge means being adapted to enable the wall panels to be folded into a stack, and a plurality of base clip arrangements for releasably holding the composite side wall enclosure to the base in its erected and folded conditions, the knock down box being stackable in both the erected and folded conditions, and including upper panel alignment and box support means provided along the operatively top edges of the side wall panels, and complemental lower panel alignment means provided on the base, with the upper panel alignment and box support means of a subjacent box being arranged to interengage with and to nest within the lower panel alignment means of a superjacent box when the erected boxes are stacked on top of one another.

Preferably, the upper panel alignment and box support means are located towards the outer corners of the composite side wall, and the lower panel alignment means include complemental corner recesses on the pedestals.

Conveniently, the upper panel alignment means comprises a plurality of panel aligning formations each formed with an angled contact face which slopes downwardly and outwardly, and the lower panel alignment means comprises a plurality of complemental panel aligning formations each formed with an corresponding angled contact face which slopes upwardly and inwardly, such that interengagement of the contact faces results in the upper edges of the side walls being urged inwardly into firm nesting interengagement with the complemental panel aligning formations.

Typically, mounting means are provided for holding the base clips captive on the base.

Advantageously, the base clips comprise drop-away substantially L-shaped sprung clips which each have a lower pivoting end held captive within a clip-retaining assembly in the base panel and an upper end terminating in an inwardly facing tang which are releasably engageable with horizontal locating slots formed towards the lower edges of the side wall panels. Advantageously, outer corner faces of the pedestals carry corner reinforcing brackets which are formed with upper inwardly directed tangs constituting base clip arrangements which are engageable with horizontal locating slots formed towards the lower corner edges of the side wall panels.

The brackets are preferably formed with lower inwardly directed flanges which extend into the corner recesses and form part of the lower panel alignment means.

According to a second aspect of the invention, there is provided a stackable knock down box comprising a base including a base panel supported on a plurality of pedestals, a plurality of side wall panels, hinge means connecting the side wall panels together to define a composite side wall enclosure, the hinge means being adapted to enable the side wall panels to be folded into a stack, and a plurality of base clip arrangements for releasably holding the composite side wall enclosure to the base in both its erected and folded conditions, the hinge means comprising first and second hinge plates joined together by means of a pivot assembly and arranged to be mounted to the operatively outer surfaces of the adjacent side wall panels by means of fixing elements, each of the hinge plates terminating in inwardly projecting tangs for locating in corresponding slots in the adjacent side wall panels so as to relieve shear stress on the fixing elements arising from an outwardly directed force being exerted on the wall panels when in an open condition.

Conveniently, the pivot assembly is recessed relative to the outer corner faces of the composite side wall enclosure and defines a pivot axis which is locatable in the region of an intersection of the operatively inner surfaces of the adjacent side wall panels, with the hinge plates being formed with inwardly angled connecting webs or fingers extending inwardly between the outer faces of the hinge plates and the pivot axis.

Advantageously, each of the first and second hinge plates are formed with at least one aperture for receiving the fixing elements, with the aperture conveniently being surrounded by an annular protective boss, and the pivot assembly comprises a hinge pin and a plurality of interdigitating plate fingers extending from each of the webs and scrolled around the hinge pin.

Typically, the knock down box is a two part box, with all the box components being carried either on the base or the composite side wall.

Locating means are typically provided on the base for locating the stacked composite side wall.

Preferably, overhanging strike plates are fitted to at least one of the side wall panels for allowing the base clip arrangements to ride up and over the strike plates to clamp the composite side wall to the base.

Optionally, the box includes an intermediate foldable shelf assembly providing horizontal partitioning for the box.

In a preferred form of the invention, the pedestals are fitted with skid planks which are arranged to nest completely within a subjacent box.

DESCRIPTION OF EMBODIMENTS

Figure 1:
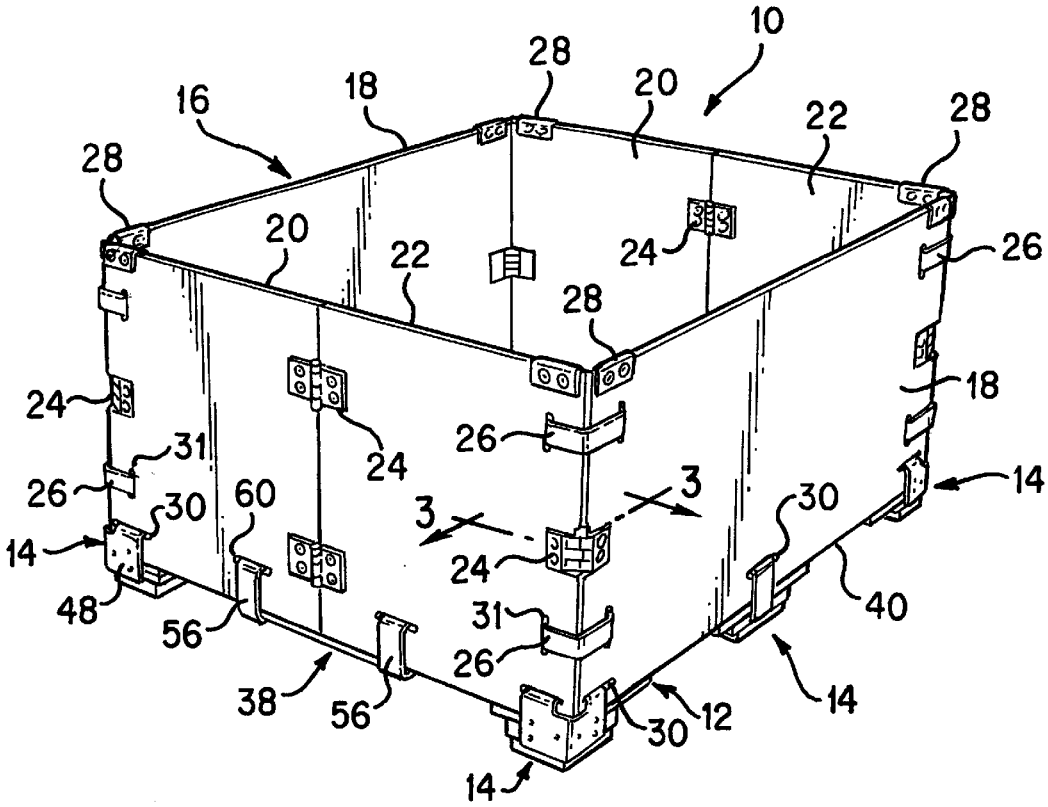
FIG. 1 shows a perspective view of a first embodiment of an assembled box of the invention.

A first embodiment of a box 10 of the invention is shown in FIG. 1 to include a base 12, six support pedestals 14 which are attached to the base, and a composite side wall 16. The side wall 16 includes three pairs of opposed side wall panels 18, 20 and 22. The side wall panels are joined to one another by hinges 24 and spring clips 26. The upper edges of the wall panels, at the corners of the box, are covered with sheet metal reinforcing elements 28 which are fixed to the panels. The wall panels additionally include horizontal slots 30 adjacent their lower edges at the corners of the box. The side wall spring clips 26 are right angled and carry spring clip formations which are releasibly engageable in vertical slots 31 in the panels adjacent their corners. One leg of each of the spring clips 26 is fixed to one of the panels by means of rivets or the like.

Figure 2:
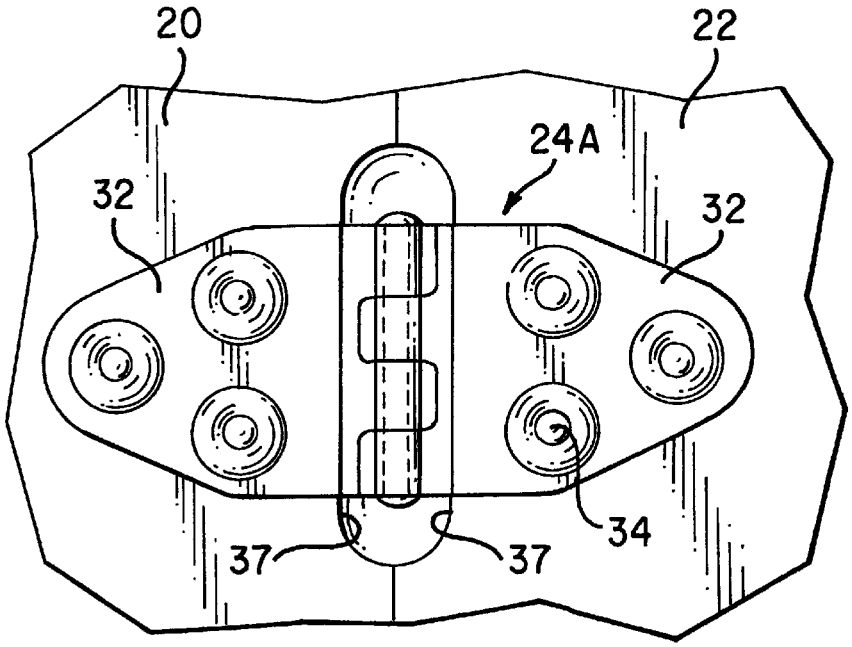
FIG. 2 shows a front elevation of one of the box wall panel hinges of FIG. 1.
Figure 3:
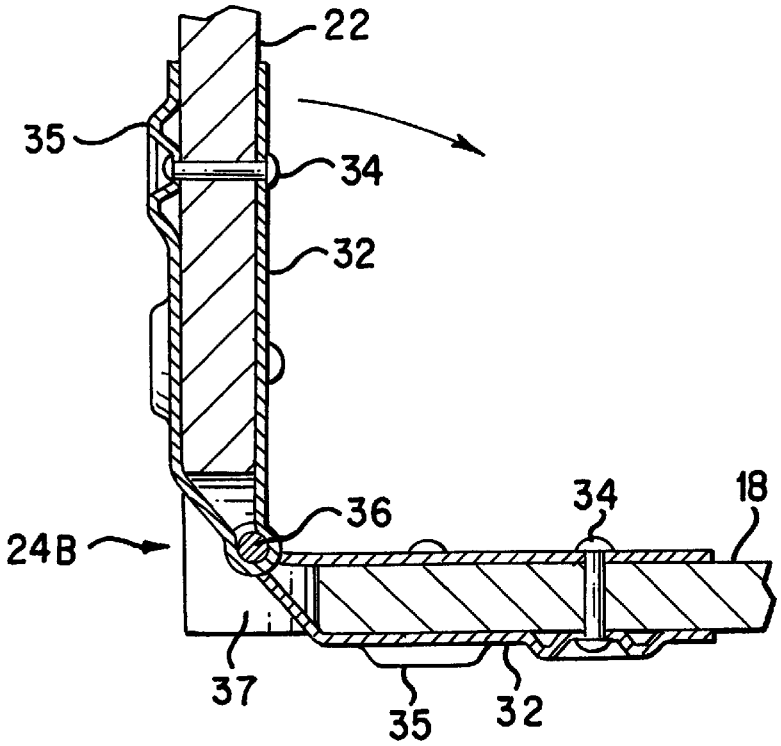
FIG. 3 shows a sectioned plan view of a corner hinge of the box along the line 3—3 of FIG. 1.

The hinges 24 are more clearly seen in FIGS. 2 and 3 with the hinge 24A of FIG. 2 being a hinge between two of the panels 20 and 22 and the hinge 24B of FIG. 3 a corner hinge. Each leaf 32 of the hinge is double sided, as is shown in FIG. 3, so as to embrace the panel to which it is attached by means of rivets 34. The outer of the two leaf plates of each leaf has a raised annular formation 35 which surrounds and extends above the head of the rivets 34 to protect the rivets from handling damage. The hinge pins 36 are, again as shown in FIG. 3, offset from the centre of the panels to be located in cut-outs 37 in the panels to ensure that the hinges are recessed from the outer surface of the wall panels for protection against damage.

Figure 6:
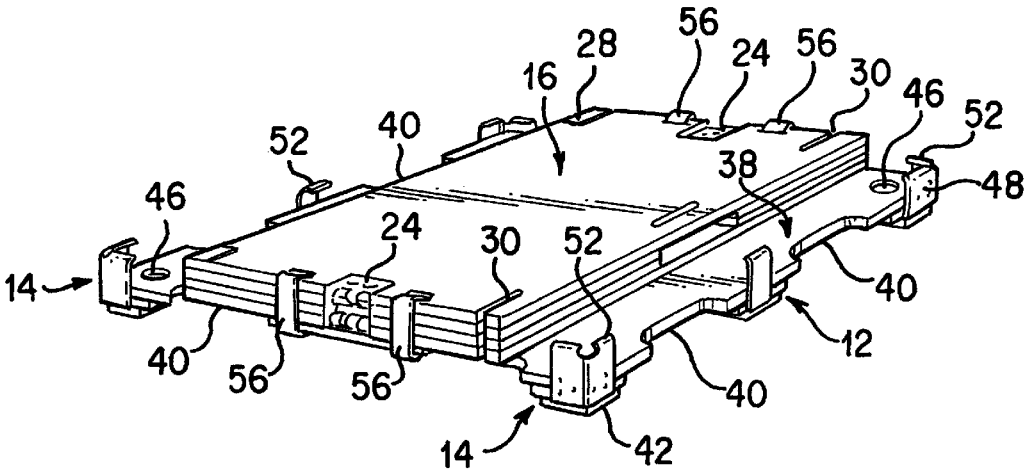
FIG. 6 shows a perspective view from above of the FIG. 1 box in its knocked down condition.

The base 12 of the box, as is better seen in FIG. 6, consists of a flat panel 38 which has two cut outs 40 in each edge for providing vertical ventilation through the box 10 when assembled. The spacing between the base pedestals 14 allows for four-way entry for a 90 mm high pallet-jack.

As is clear from FIG. 5, the edges of the base panel 38 between the cut outs 40, which in use are below the wall panels 20 and 22, are rebated to provide steps 41 having a width corresponding to the thickness of the panels 20 and 22 so that the lower panel edges are locatable in the recesses when the box is assembled. The purpose of this arrangement is for the vertical face 41A of the step 41 to provide a stop against which the inner faces on the hinged panels 20 and 22 may abut to prevent the hinged walls from folding inwardly into the assembled box.

Figure 4:
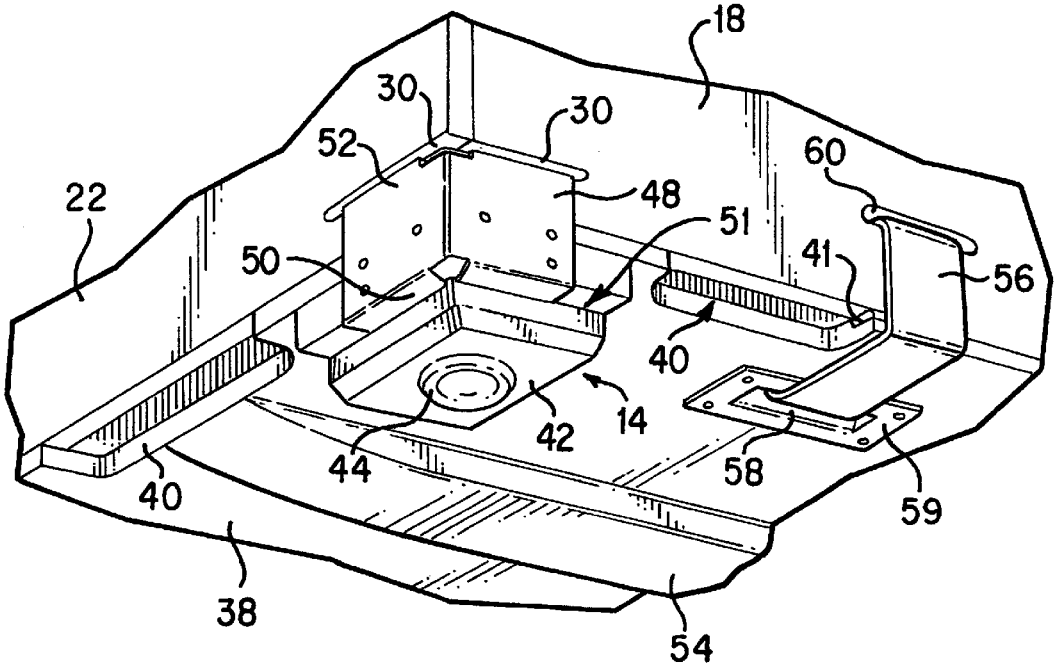
FIG. 4 shows a perspective view from below of one corner of the base portion of the box of FIG. 1.

The construction of the pedestals 14 is more clearly seen in FIG. 4 where the pedestals are shown to consist of compressed wooden blocks 42 which are releasibly attached to the base panel 38 by means of screws for simple replacement. The outer facing surfaces of the blocks 42 are recessed as shown in FIG. 4 by a distance slightly greater than the thickness of the wall panels of the box. The underside of the block 42 carries a projecting foot 44 which is made from a robust plastics material. The upper surface of the base panel 38, as shown in FIG. 6, is provided with recesses 46 above each of the pedestals 14 and in which the pedestal feet 44 are engageable when knocked down boxes are stacked one on the other. Importantly, the outer surfaces of the pedestals at the corners of the box are armoured by right angled brackets 48 which have lower inwardly directed aligning flanges 50 which are located against the recessed edges 51 of the pedestal blocks and upper inwardly directed flanges 52 which are releasibly engageable in the slots 30 at the lower edges of the wall panels.

The underside of the base panel 38 carries hard wood skids 54 to minimise fork lift damage to the underside of the boxes. The base panel 38 is held to the composite side wall 16 of the box by means of not only the flanges 52 on the brackets 48 but additionally by spring clips 56 which are shown in greater detail in FIG. 5. The clips 56 are attached to the base plate 38 of the box by means of a hinge type arrangement 58. The hinge type arrangement comprises an apertured retaining plate 59 which is formed with a retaining tang 59A extending into a slot 59B formed in the base panel. The scrolled end 56A of the sprung clip is held loosely and hingedly captive behind the tang 59A. The inwardly directed tang 56B at the free end of the clip is releasibly engaged, in the same manner as the clips 26, in slots 60 in the panels 20 and 22.

To dissemble the box from its erected position in FIG. 1, downward pressure is applied to the base of the box within the box adjacent the wall panels 20 and 22 to disengage the panels from the base steps 41 and the upper portions of the spring clips 26 which are not permanently anchored to the wall panels are pried from the grooves 31 in which they are located to release the wall panels from each other at the corners of the box. The spring clips 56 are similarly freed from the slots 60. The hinged joins between the wall panels 20 and 22 of the composite side walls, which are now free of the base steps 41, are now pressed towards one another to pull the panels 18 towards each other until the panels are in their stacked configuration. The stacked panels are now laid on the base panel 38 as shown in FIG. 6 with the drop away clips 56 engaged with the uppermost panel to hold the stacked side wall panels to the base panel. To again erect the box the knock down procedure described above is merely reversed.

In use, two or more of the filled boxes 10 are stacked one on the other with the aligning recessed portion 51 of the pedestals of the upper box located on the inside of and resting on the reinforcing elements 28 at the corner edges of the box to hold the upper box engaged with the lower box against relative sideways movement of the stack boxes. After use the boxes are knocked down as described above with one knocked down box, as shown in FIG. 6, located on another below it with the feet 44 of the pedestals engaged in the recesses 46 of the base panel below it again to resist any sideways dislocation of the stacked boxes during transit.

All of the box panels, in this embodiment of the invention, are made from plywood which is bonded with boil-proof fenal formaldehyde resin and coated with modified phenolic impregnated high density resin film on both sides. The film stiffens the plywood, gives it a great degree of abrasion and impact resistance, and while it enhances the appearance of the box it also makes the surface completely impervious to moisture. The edges of the panels are sealed with epoxy paint. Treated in this manner the box components are easily able to withstand relatively high temperatures and also allow the bins to be steam cleaned for reuse.

Figure 7:
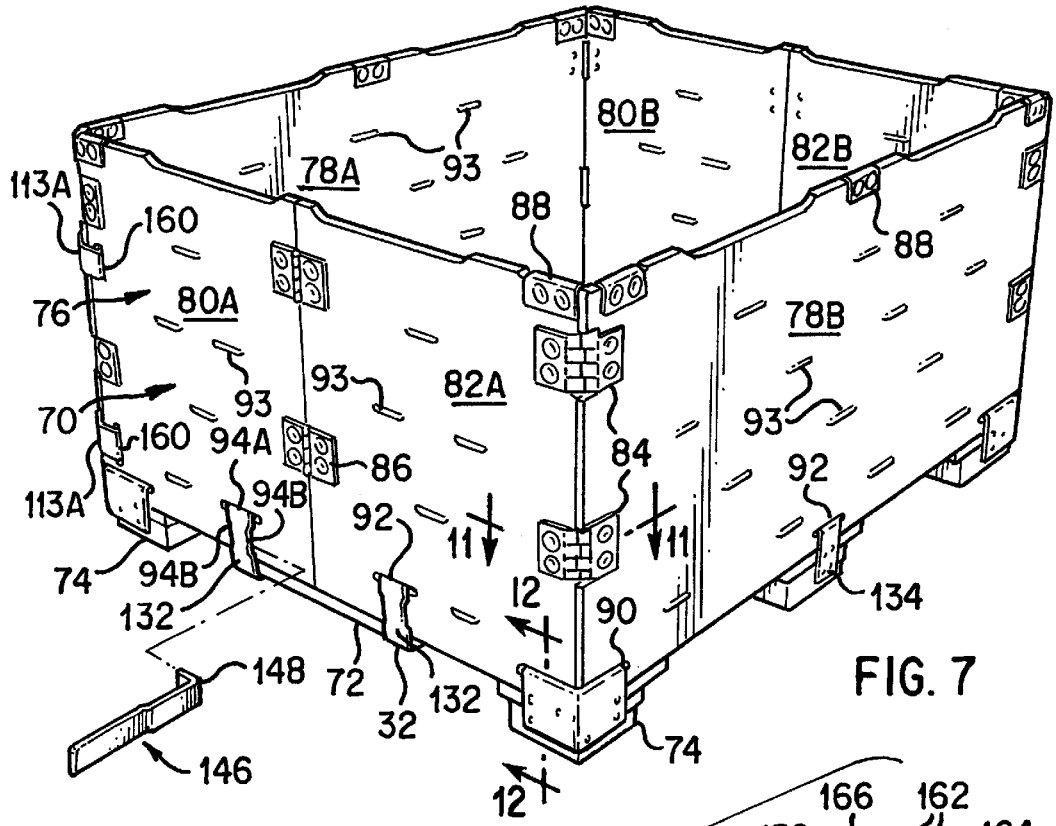
FIG. 7 shows a perspective view of a second embodiment of an assembled box of the invention.

Referring now to FIG. 7, a second embodiment of a box 70 includes a base panel 72, six support pedestals 74 attached to the base panel, and a composite side wall 76 which includes six panels arranged in opposed pairs 78A and 78B, 80A and 80B and 82A and 82B. The panels are joined to one another by corner hinges 84 and inwardly folding side wall hinges 86 connect adjacent panels 80A and 82A and 80B and 82B. Sheet metal aligning and reinforcing elements 88 are rivetted to the upper edges of the panels at the corners of the box, as well as mid-way along the side wall panels 78A and 78B. The side wall panels are provided with horizontal corner slots 90, intermediate clip-receiving slots 92, and an array of ventilation slots 93. The base panel 72 is similarly provided with ventilation slots 93A.

Figure 10:
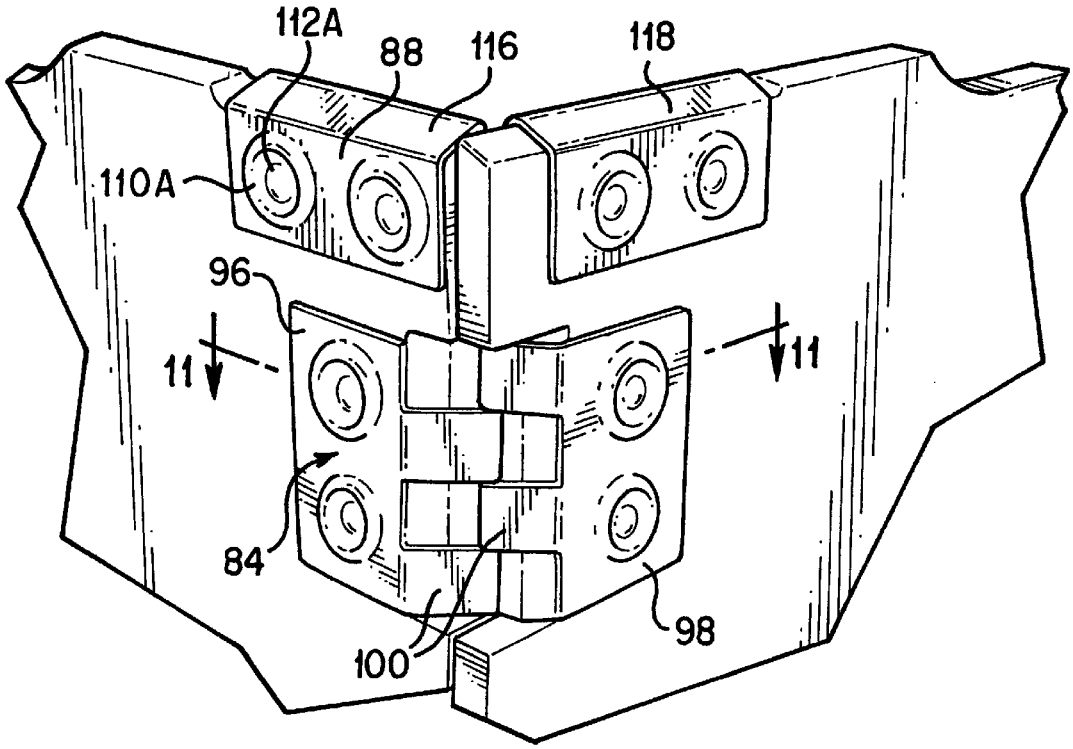
FIG. 10 shows a top corner perspective detail of a hinge and a pair of panel aligning formations forming part of the box of FIG. 7.
Figure 11:
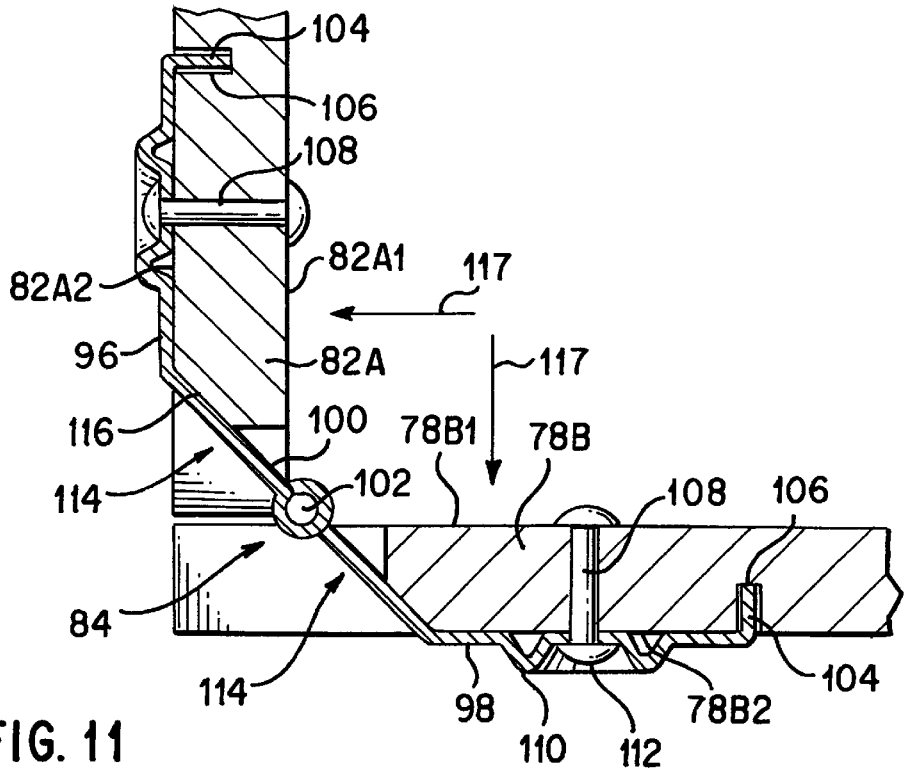
FIG. 11 shows a cross-sectional view of the hinge on the line 11—11 of FIG. 10.
Figure 12:
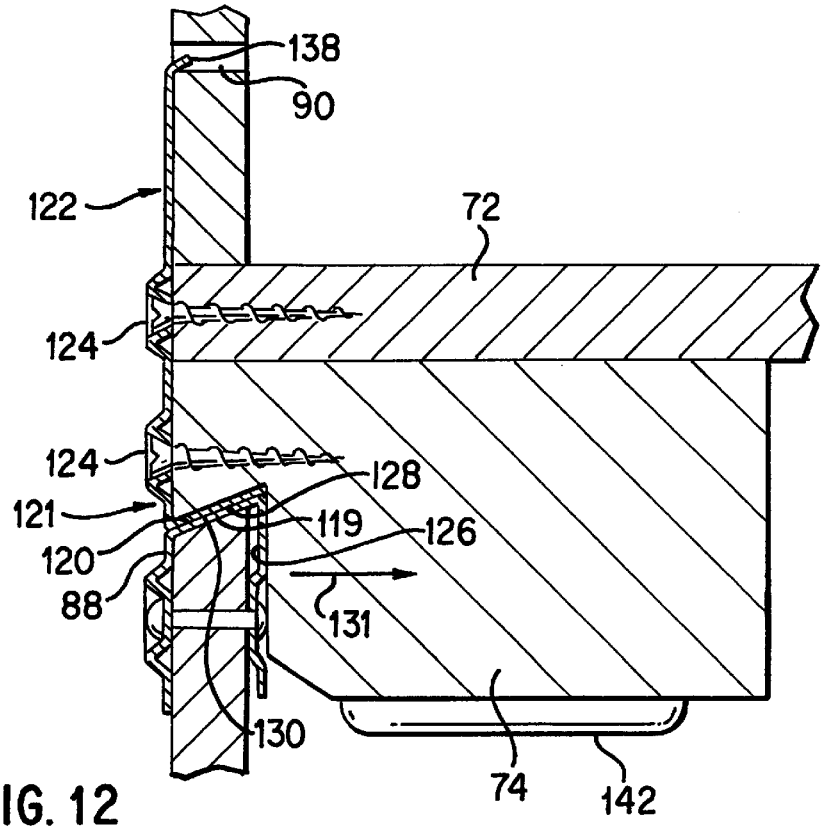
FIG. 12 shows a cross-sectional detail of a pair of erected boxes of FIG. 7 in a stacked position.

The corner hinges 84 and the aligning and reinforcing elements 88 are more clearly visible in FIGS. 10 to 12. The corner hinges 84 comprise a pair of hinge plates 96 and 98 formed from sheet metal. Inwardly angled interdigitating fingers 100 are scrolled at the ends to accommodate a central hinge pin 102. Each of the hinge plates terminate in tangs 104 which extend inwardly at right angles from the hinge plates 96 and 98 and which locate in corresponding slots 106 defined in the panels. The hinge plates 96 and 98 are connected to adjacent panels 82A and 78B by means of aluminium rivets 108, and are formed with protective annular bosses 110 within which an outermost head 112 of each of the rivets is countersunk so that the rivets are protected against handling damage.

The hinge pin 102 is offset from the centre of the panels and is located at the intersection of the inner faces 82A1 and 78B1 of the respective panels 82A and 78B so as to allow the panels to be folded together into an overlying stacked condition. This is achieved by forming protective rectangular cutouts 114 in each of the panels. The cutouts are formed with chamfered bases 116 against which the inwardly angled fingers 100 of the hinges rest. The tangs 104 perform an important stress-relieving function, in that, in the event of the hinge 84 being subjected to outward stresses, these stresses are not only borne by the rivets 108 bearing against the relatively small areas of the rivet holes in the panels, but also by virtue of the tangs 104 bearing against the inner faces of the slots 106 to take up and distribute the stresses. As a result, the hinges are still functional and tend to stay in position, even in the event of a particular rivet being damaged or even working loose completely. As the hinge plates 96 and 98 are anchored against the outer faces 78B2 and 82A2 of the respective panels 78B and 82A, they are far better configured to absorb outward pressure or impact in the direction of arrows 117. This would not be so were the hinge plates 96 and 98 located on the inner surfaces 78B1 and 82A1 of the panels, as would be applicable in the case of a conventional hinge, where the hinge plates are mounted to those panel faces which fold towards one another.

FIGS. 10 and 12 clearly illustrate how the sheet metal reinforcing and aligning elements 88 are rivetted to the top edge corners of adjacent side walls of the box by means of rivets 112A, the heads of which are similarly located within protective raised annular formations 110A. The reinforcing and aligning formations 88 are substantially U-shaped and are formed with angled contact faces 119 which slope downwardly and outwardly at an angle of about 20° from the horizontal, and fit snugly over the complementally chamfered top edges 120 of the side wall panels.

Each of the pedestals 74 is similarly fitted with a complemental reinforcing and aligning insert 121 which forms the lowermost portion of an angled reinforcing bracket 122 which is screwed to the base panel 72 and each of the corner pedestals 74 by means of wood screws 124. The outer facing surfaces of the pedestals 74 are formed with recesses 126 which are slightly deeper than the thickness of a wall panel of the box. The recesses 126 are provided with an overhanging top face 128 which is angled downwardly and outwardly so as to accommodate the corresponding inwardly and upwardly angled contact face 130 of the complemental reinforcing and aligning insert 121. In FIG. 12, it is clearly apparent how the complementally angled contact faces 116 and 130 of the panel aligning formations result in the upper edges of the side walls of a subjacent box being forced inwardly in the direction of arrow 131 when a superjacent box is stacked on top of it. All of the corners of a subjacent box will thus be urged inwardly, even when there is initial misalignment of a superjacent box, with misalignment of up to a wall thickness or more being catered for by progressive interengagement of the complementally sloping contact faces 130 and 116. The intermediate reinforcing and aligning elements 88 on the side walls 78A and 78B will similarly be pulled inwardly by virtue of screw-in side brackets 131 A being provided with upwardly and inwardly angled contact faces which are identical in cross-section to those illustrated in FIG. 12. The aligning inserts serve to relieve outward pressure on the corner hinges 84.

Figure 8:
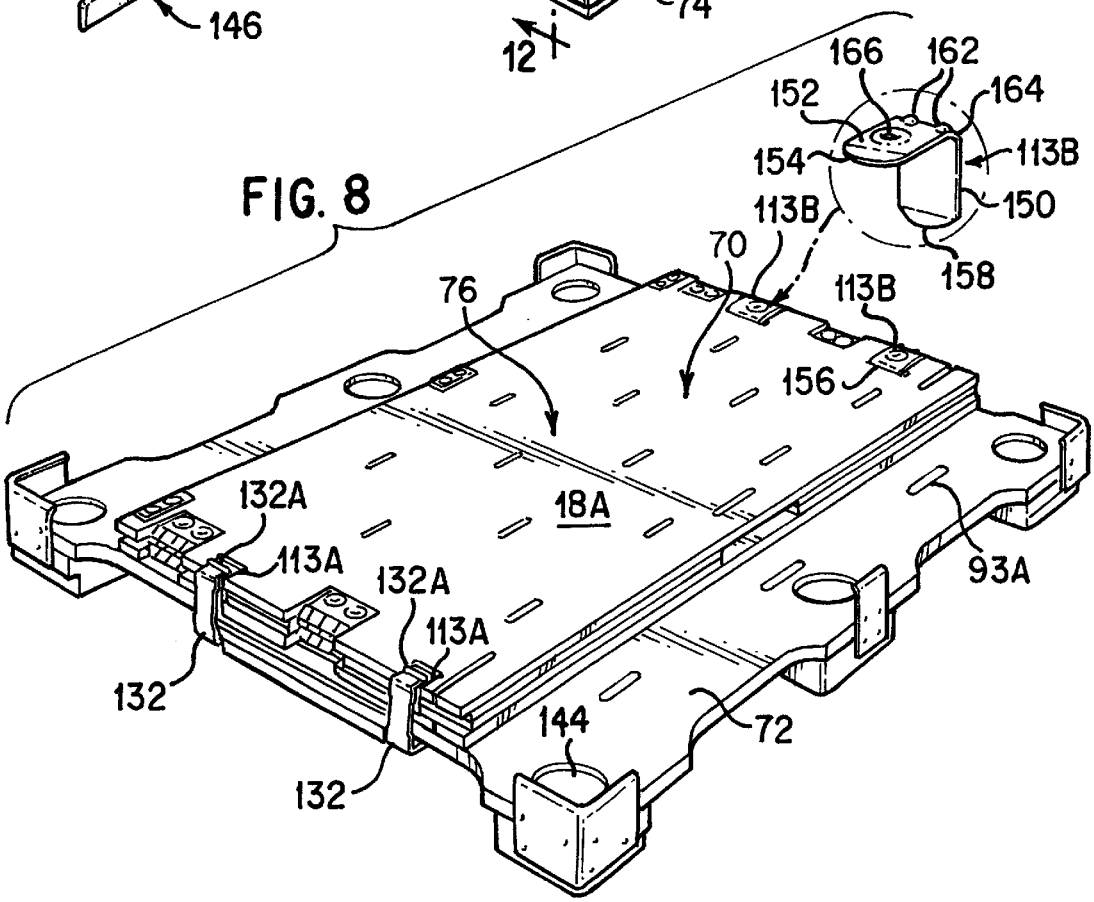
FIG. 8 shows a perspective view of the box of FIG. 7 in the knocked down condition.

Referring now to FIG. 8, the box 70 is shown in a knocked-down configuration in which drop-away L-shaped spring clips 132 are used to clamp the composite side wall 76 to the base 72 of the box. Pairs of strike plate formations 113A and 113B are riveted to the outer surface of the side panel 78A along opposite side edges thereof.

Figure 9:
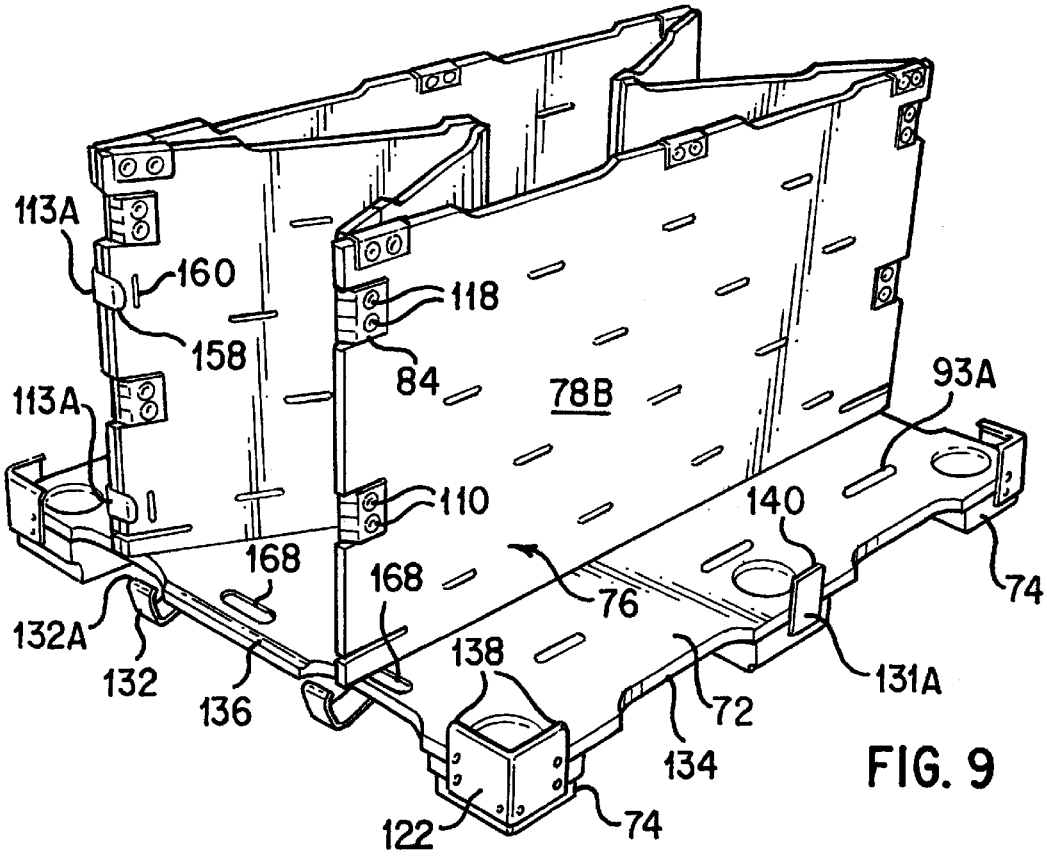
FIG. 9 shows a perspective view of the box of FIGS. 7 and 8 in a semi-erected condition.
Figure 13:
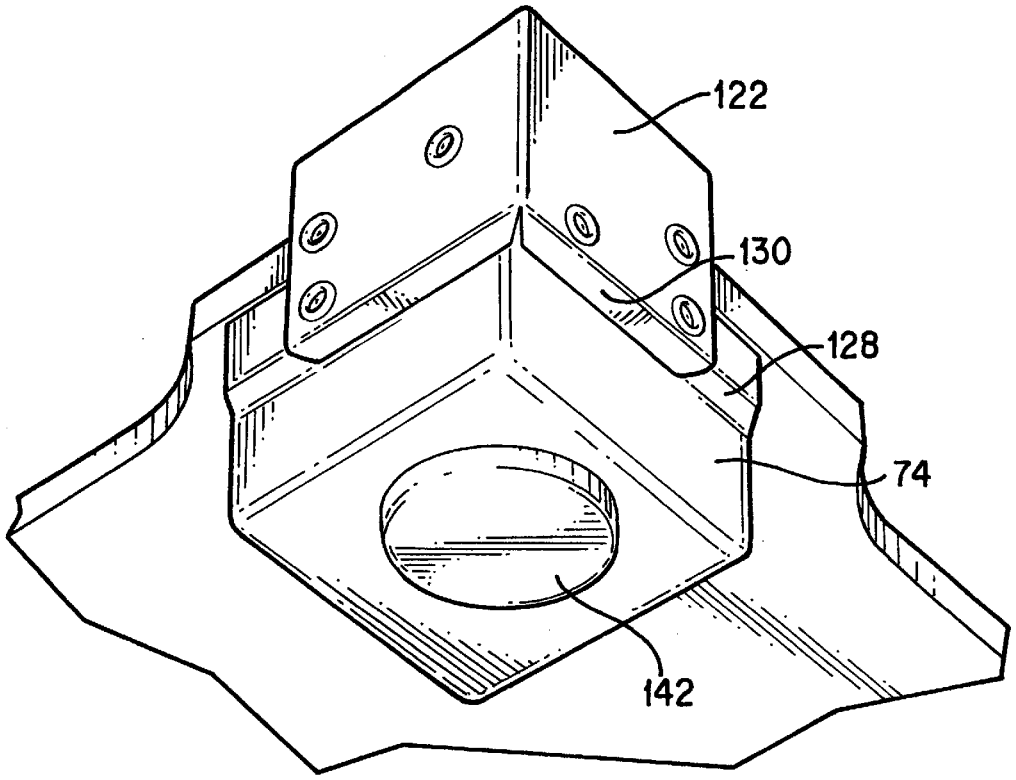
FIG. 13 shows a perspective view from below of one corner of the base portion of a box of FIG. 7.

In FIG. 9, the knock-down box 72 is shown in an intermediate position in which the composite side wall 76 is being folded into a flat condition. The base panel 72 is provided with scalloped ventilation cutouts 134, and stepped recesses 136 locate the lower edges of the side walls 80A, 82A, 80B and 82B when the box is erected. Both the corner brackets 122 and the side brackets 131A are formed respectively with inwardly directed tangs 138 and 140 which locate within the respective complemental slots 90 and 92 to clamp the composite side wall to the base when the box is erected. As is clear from FIG. 13, the pedestals 74 are provided with glide feet 142 which locate within complemental circular recesses 144 when the knocked down boxes are stacked on top of one another.

The erected box of FIG. 7 is knocked down in the following manner. A levering tool 146 is provided with an L-shaped blade 148, the end of which is wedged between one of a pair of raised access openings 94B defined in each of the clips 132 and the adjacent side panels. The tangs 132A of the clips are then levered out of the slots 92 so that the clips drop away into the FIG. 9 position. The side panels 80A and 82A and 80B and 82B are raised so that their lower edges ride over the stepped recesses 136, and the major side panels 78A and 78B are disengaged from the bracket tangs 90 and 92 and pushed inwardly towards one another so that the entire composite side wall 76 is folded together into a double-M stackable configuration in the manner illustrated in FIG. 9. The composite side wall is then located on top of the base 72 and the clips 132 are then forced upwards and inwards so that the tangs 132A ride over the outer faces of the downwardly depending legs 150 of the L-shaped strike plates 113A and 113B.

Each of the strike plates 113A and 113B is provided with a fixed leg 152 which terminates in a tang 154 which locates within a complemental slot 156 located in the side panel 78A. A similar tang 158 projects from the downwardly depending leg 150 of each of the strike plates, and locates within complemental slots 160 defined within the outer faces of the side panels 80A and 80B when the box is in the erected FIG. 7 condition. The tangs 158 are freed from the complemental slots 160 as the box is folded into a stacked configuration, as can clearly be seen in FIG. 9. The strike plates 113A serve to cover the irregular stacked profile of the side edges of the composite side wall 76 and allow the tangs 132A to ride up over the smooth outer faces of the legs 150 of the strike plates. Each of the strike plates are formed with a pair of raised bosses 162 on their corners 164 between the legs 150 and 152. The bosses serve a retaining function for retaining the tangs 132A in the FIG. 8 position in which they ride up and over the bosses and locate against the upper face of the leg 152. The leg 152 is formed with a rivet hole surrounded by an annular protective boss 166.

Referring back to FIG. 9, the base 74 is formed with four elongate boss-locating cut-outs 168 which serve to locate the annular bosses 110 on the corner hinges 84 which are fitted to the side panels 78B. The recesses 168 thus serve to prevent the folded composite side wall 76 from sliding around on top of the base 72. In addition, they serve to register the composite side wall on the base in such a way that the strike plates 113A are in vertical alignment with the drop-away clips 132.

Figure 14:
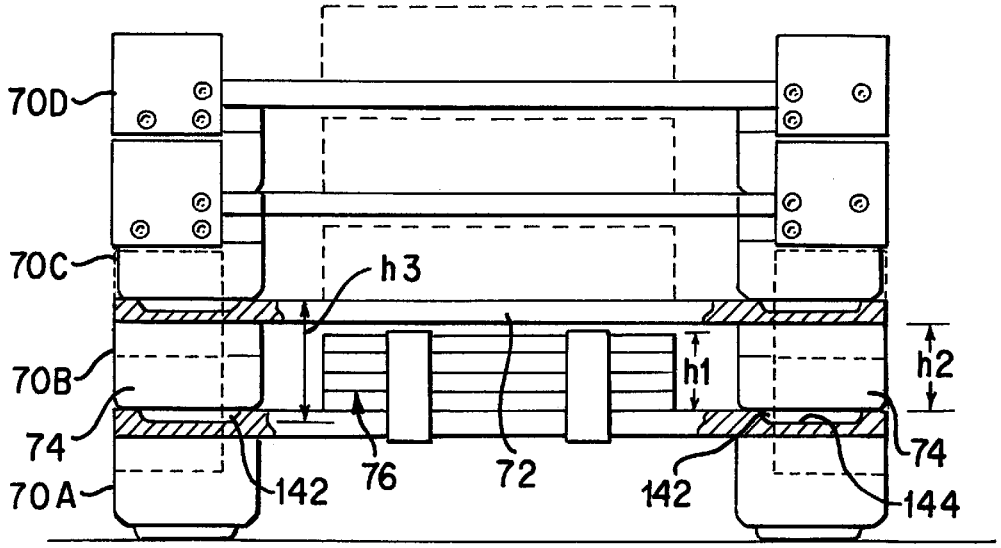
FIG. 14 shows a partly cut-away side view of a stack of knocked down boxes of FIG. 8.

Referring now to FIG. 14, a stack of knocked down boxes 70A, 70B, 70C and 70D is shown. The height h1 of the stacked composite side wall 76 is marginally less than the height h2 of 85 mm of the pedestals 74, with the result that the knocked down boxes can be stacked on top of one another with the feet 142 of an overlying box locating snugly within the complemental circular recesses 144 formed in an underlying box and the base 72 of an overlying box straddling the stacked composite side wall 76 of an underlying box. The overall effective height h3 of a stacked container is reduced by the fact that the foot 142 nests within the complemental recess 144 in an underlying knocked down box or container. This reduces the effective height of each container by the 10 mm height of each foot 142, and results in twenty knocked down boxes occupying a total height of only 2.1 m. The feet 142 are formed from a nylon material and have a smooth finish. An important advantage of this is that the feet 142A of the lowermost container are able to glide on the loading surface with far less frictional resistance than the wooden block 74 on which the feet are mounted. The feet thus allow a box to glide more easily on the loading surface when such a box is mishandled by the tines of a fork lift truck, rather than allowing the tines to penetrate the side walls of a loaded box, which often tends to occur in the case of heavily loaded boxes or stacks of boxes which are not fitted with glide feet 142.

Figure 15:
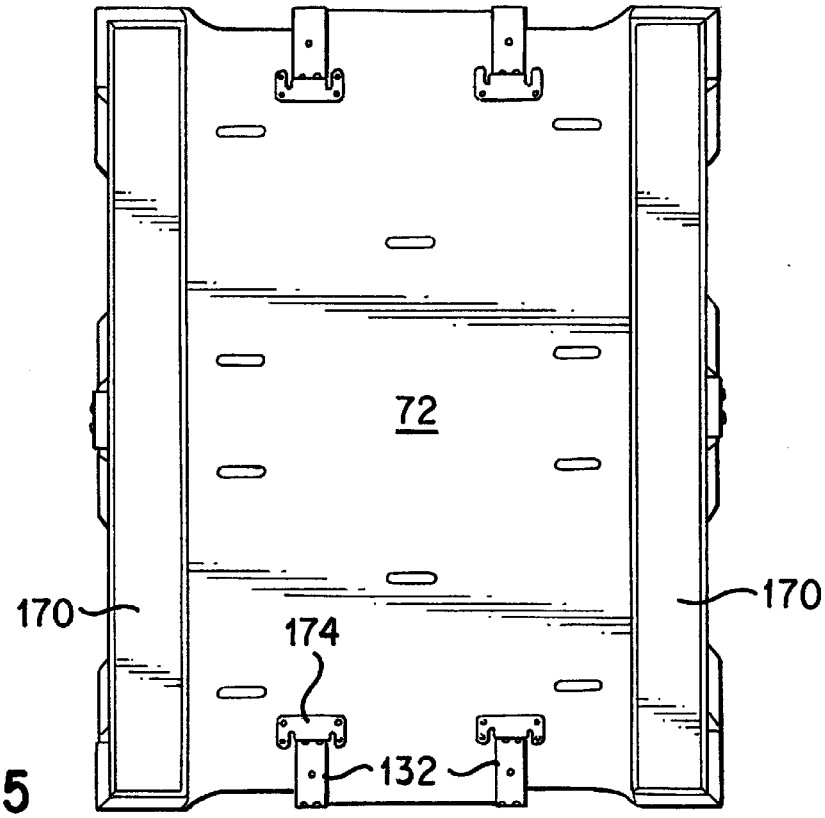
FIG. 15 shows an underplan view of a third embodiment of an assembled box of the invention.
Figure 16:
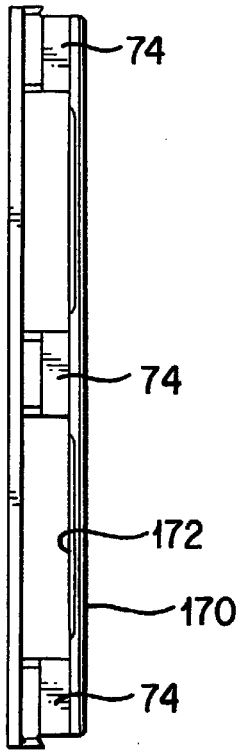
FIG. 16 shows a side view of a pallet forming part of the third embodiment of FIG. 15.

In an alternative form of the invention illustrated in FIGS. 15 and 16, where stacked boxes require greater stability for loading on conveyors, flat bed trucks and the like, the glide feet are replaced with a pair of parallel skid planks 170 which are screwed onto the three outermost rows of blocks 74. Naturally, the stacked height of such boxes is significantly increased as the skid planks 170 sit on the underlying base panels 72. The side and end edges of the skid planks are flush with the corner blocks so as to allow the skid planks, together with the blocks, to nest snugly within the top opening of a subjacent container when the boxes are erected. The top edges of the skid planks are formed with chamfers 172 for enabling easier access for wheeled hand pallet trucks.

Figure 5:
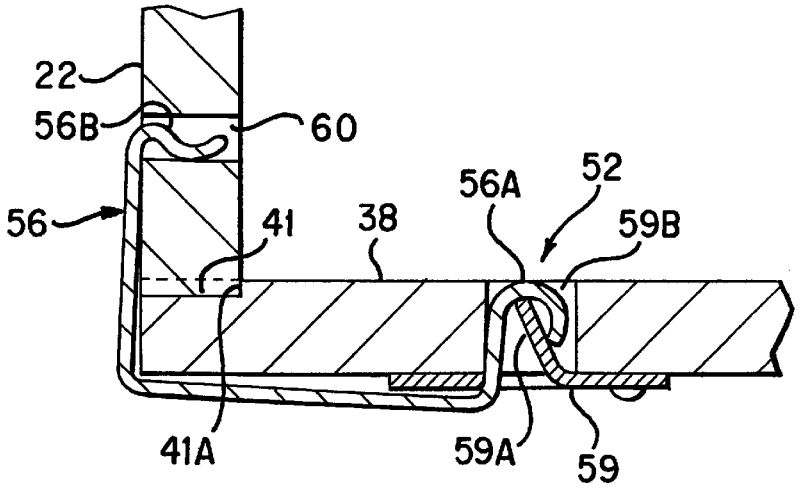
FIG. 5 shows a fragmentary sectioned side elevation of the base and a side wall of the box of FIG. 1 illustrating the clip arrangement for holding the base and side walls together.

As is clear from FIG. 15, the base plate 72 is fitted with four clip-retaining plates 174 which are substantially C-shaped in form, and which hold the scrolled ends of the drop-away clips 132 loosely and hingedly captive in the same manner as the retaining plates 59 of FIGS. 4 and 5.

Figure 17:
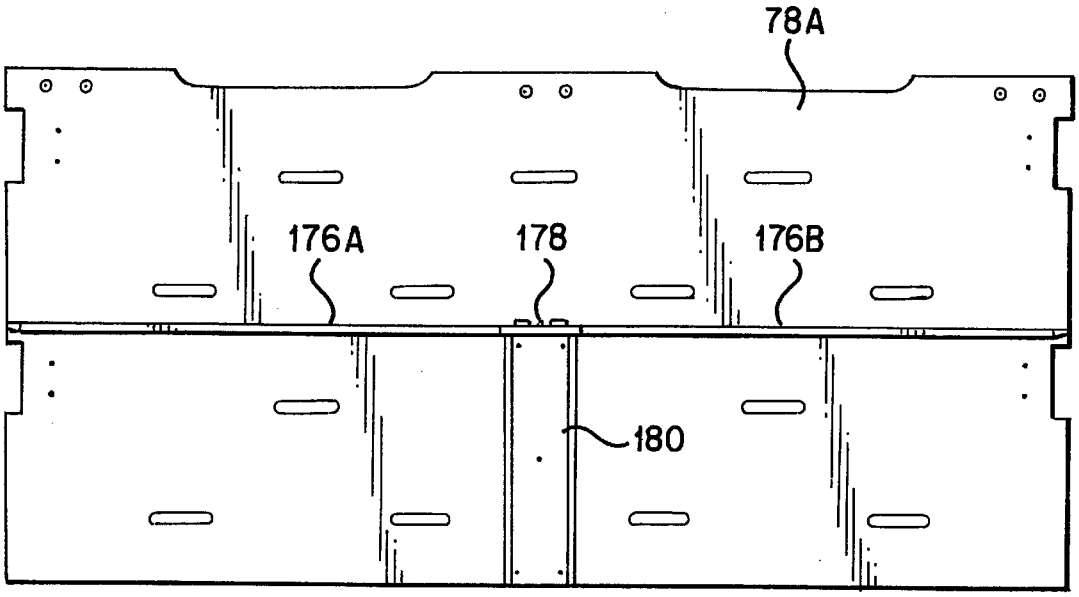
FIG. 17 shows a side view of part of a fourth embodiment of a box of the invention incorporating a shelf.
Figure 18:
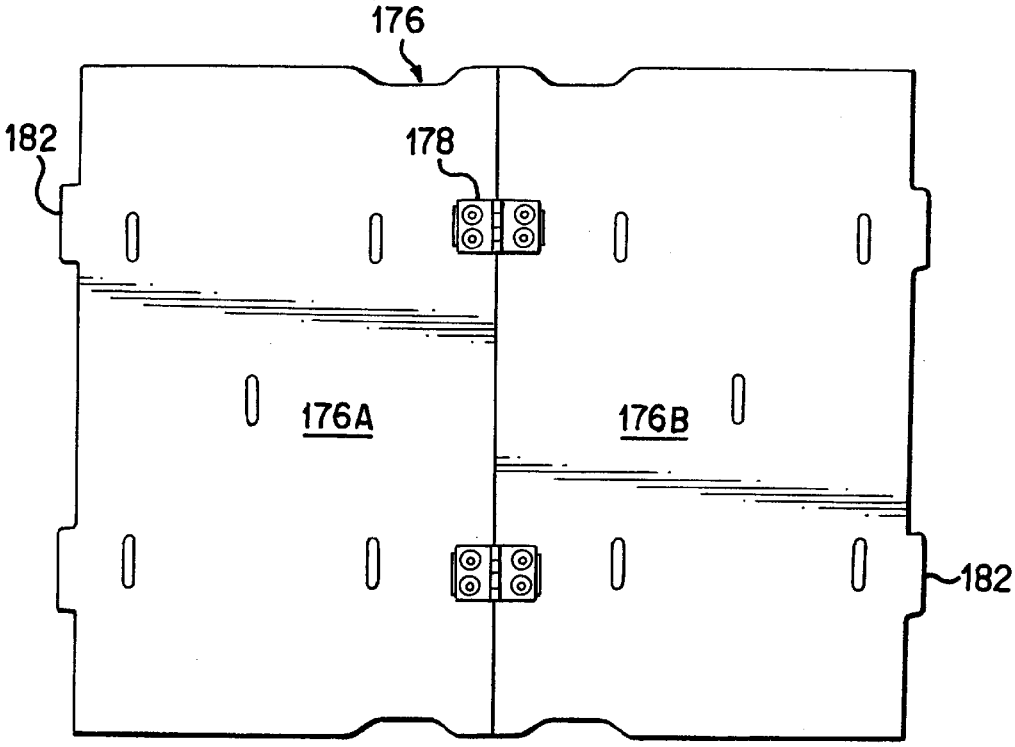
FIG. 18 shows a top plan view of the shelf of FIG. 17.

Referring now to FIGS. 17 and 18, a still further version of a box is shown which is provided with an intermediate shelf 176. The shelf 176 is formed from two folding panels 176A and 176B which are hinged together by means of straight hinge assemblies 178. The shelf 176 rests on a pair of wooden support cleats, one of which is shown at 180, which are bolted to the central interior faces of the side panels 78A and 78B. Additional support is provided by tongues 182 which extend from the free edges of the shelf panels 176A and 176B, and which are chamfered to allow them to locate firmly within horizontal slots formed at the correct height within the end panels 80A, 82A, 80B and 82B. The shelves are provided for transportation of fruits which tend to bruise easily, and which cannot be stacked at a height greater than half the height of the box. The shelves do not form part of the stowed assembly illustrated in FIG. 8. Rather, during transportation of the stacked boxes, approximately twenty shelves are stowed separately in an erected box.

The box of the invention has a particularly rugged construction arising from the structure of the hinges, the corner and side brackets and the reinforcing and aligning elements. The stackability of the box in the knocked down and erected conditions and the sturdiness of the knocked down and erected stacks allows the box to be readily and repeatedly transported both when knocked down and erected. In addition, as the box is essentially two-part in form, with no loose components, the possibility of components being mislaid during transit is eliminated.

I claim:

1. A stackable knock down box comprising a base including a base panel supported on a plurality of pedestals, a plurality of side wall panels, hinge means connecting the side wall panels together to define a composite side wall enclosure, the hinge means being adapted to enable the side wall panels to be folded into a stack, and a plurality of base clip arrangements for releasably holding the composite side wall enclosure to the base in both its erected and folded conditions, the knock down box being stackable in both the erected and folded conditions, and including upper panel auto-alignment and box support means provided along the operatively top edges of the side wall panels, and complemental lower panel auto-alignment means provided on the base, with the upper panel auto-alignment and box support means of a subjacent box being arranged to interengage with and to nest within the lower panel auto-alignment means of a superjacent box when the erected boxes are stacked on top of one another, wherein the upper panel auto-alignment and box support means comprises a plurality of panel converging formations, each formation being formed with a contact face which slopes downwardly and outwardly, and being located towards the outer corners of the composite side wall, and the lower panel auto-alignment means includes complemental corner stabilizing recesses on the pedestals, each of the recesses comprising corresponding overhanging corner contact faces which slope upwardly and inwardly and adjoin recessed outwardly facing perpendicular corner faces such that interengagement of the converging formations and the corner stabilizing recesses results in the upper edge corners of the side walls of an underlying box being converged inwardly into firm nesting and aligned interengagement with the complemental corner stabilizing recesses on the pedestals of an overlying box, wherein the plurality of panel converging formations including reinforcing inserts defining the downwardly and outwardly angled contact faces, and the corner-stabilizing recesses include corresponding reinforcing inserts defining the overhanging corner contact face.

2. A stackable knock down box according to claim 1 in which mounting means are provided for holding the base clips loosely and hingedly captive on the base when the clips are not engaged with the side walls in either of the erected or folded conditions, the base clips comprising drop-away substantially L-shaped sprung clips which each have a lower pivoting end held captive within a clip-retaining assembly in the base panel and an upper end terminating in an inwardly facing tang which is releasably engageable with horizontal locating slots formed towards the lower edges of the side wall panels, the clip retaining assembly comprising a slot extending into the base panel, and a retaining plate at least partly surrounding the slot and mounted to the base panel, the retaining plate including a retaining tang extending into the slot, and the pivoting end of the base clip having an outwardly scrolled formation which is arranged to ride over an innermost edge of the tang to be held loosely captive thereby within the slot.

3. A stackable knock down box according to claim 1 in which outer corner faces of the pedestals carry corner reinforcing brackets which are formed with upper inwardly directed tangs constituting base clip arrangements which are engageable with horizontal locating slots formed towards the lower corner edges of the side wall panels.

4. A stackable knock down box according to claim 3 which the brackets are formed with lower upwardly and inwardly directed flanges which extend into the corner recesses and constitute the corresponding reinforcing inserts.

5. A stackable knock down box according to claim 1 in which the knock down box is a two part box, wherein the plurality of base clip arrangements include panel connecting components and side wall clip receiving slots, and the panel connecting components remain attached to the base when the components are not engaged with the clip receiving slots of the side walls in either of the erected or folded conditions.

6. A stackable knock down box according to claim 1 in which locating means are provided on the base for locating the stacked composite side wall.

7. A stackable knock down box according to claim 1 in which overhanging strike plates are fitted to at least one of the side wall panels for allowing the inwardly facing tangs of the L-shaped spring clips to ride up and over the outer surfaces of the strike plates to clamp the composite side wall to the base when in the folded condition.

8. A stackable knock down box according to claim 1 which includes within a subjacent an intermediate foldable shelf assembly providing horizontal partitioning for the box.

9. A stackable knock down box according to claim 1 in which the pedestals are fitted with skid planks which are arranged to nest completely within a subjacent box.

10. A stackable knock down box according to claim 7 which the strike plates are L-shaped, each strike plate having a free leg arranged to cover an irregular stacked profile of the side edges of the composite side wall and a fixed leg mounted to the side wall panel.

* * * * *